US006238277B1

(12) United States Patent
Duncan et al.

(10) Patent No.: US 6,238,277 B1
(45) Date of Patent: May 29, 2001

(54) MULTIDISC FLOOR GRINDER

(76) Inventors: C. Warren Duncan, 1281 Logan Ave., Suite F, Costa Mesa, CA (US) 92626; William D. Glynn, 521 Babbs Rd., West Suffield, CT (US) 06093

( * ) Notice: Subject to any disclaimer, the term of this patent is extended or adjusted under 35 U.S.C. 154(b) by 0 days.

(21) Appl. No.: 09/320,751

(22) Filed: May 27, 1999

(51) Int. Cl.[7] ..... B24B 7/00
(52) U.S. Cl. ..... 451/271; 451/353
(58) Field of Search ..... 451/271, 270, 451/350, 353, 357, 359; 15/49.1, 50.1, 98

(56) References Cited

U.S. PATENT DOCUMENTS

| | | | | |
|---|---|---|---|---|
| 3,701,221 | * | 10/1972 | Vinella | 51/177 |
| 4,097,950 | * | 7/1978 | Satterfield | 15/49 R |
| 4,319,434 | * | 3/1982 | Brejcha | 51/177 |
| 5,548,860 | * | 8/1996 | Weltikol et al. | 15/50.1 |
| 5,863,241 | * | 1/1999 | Rottschy | 451/271 |

* cited by examiner

*Primary Examiner*—Timothy V. Eley
*Assistant Examiner*—Dung Van Nguyen
(74) *Attorney, Agent, or Firm*—Charles H. Thomas

(57) ABSTRACT

A multidisc floor grinder is constructed as a wheeled device that may be moved about the floor by means of a handle. The chassis of the floor grinder supports a bearing housing on gimbals that allow the bearing housing to vary in orientation as the device is moved across an uneven floor. The gimbals are aligned to allow rotation of the bearing housing about a bearing housing axis that is parallel to the floor. The bearing housing supports a main drive shaft which extends downwardly from the bearing housing. The main drive shaft is rotatable relative to the bearing housing within its bearings. A grinder mounting frame is rotatably mounted about the main drive shaft and is supported therefrom. The grinder mounting frame is driven in rotation about the main drive shaft at a greatly reduced speed relative to the rotation of the main drive shaft. The grinder mounting frame carries a plurality of grinding elements which are also driven from the main drive shaft, but at a substantially increased speed of rotation relative thereto. The grinding elements thereby rotate not only about their own axes, but also about the axis of the main drive shaft so as to cover a relatively large floor area with relatively small grinding elements. This arrangement substantially reduces the time required to grind paint or other matter from a floor surface.

17 Claims, 6 Drawing Sheets

MULTIDISC FLOOR GRINDER

BACKGROUND OF THE INVENTION

1. Field of the Invention

The present invention relates to a mobile machine for grinding the surface of a floor, with particular utility of use on concrete floors.

2. Description of the Prior Art

For many years a need has existed for resurfacing concrete floors. That is, concrete floors that have once been surfaced are often ultimately resurfaced. In order to resurface a concrete floor it is often necessary, and certainly desirable, to remove remnants of the old surfacing material. For example, the paint on concrete floor surfaces with time often becomes chipped and the floors themselves become pitted. Before repainting or otherwise applying a new surface to the floor, it is highly advisable to remove the old paint.

Linoleum and other floor surfacing that is secured by adhesive to a floor often becomes cracked and broken with time. Individual tiles or even sections of sheets of floor finishing materials that are secured by adhesives to the floor often become loose over a period of time. In order to resurface the floor, it is necessary to remove the remnants remaining of the old surfacing material, as well as the hardened adhesive that once held the original material to the floor.

A variety of scraping, grinding, and blasting machines have been utilized to refinish floor surfaces. For example, hand-manipulated, electrically powered grinding machines are sometime used for this purpose. Such hand grinding machines typically have abrasive grinding blades or pads about seven inches in diameter. An operator must laboriously move the device across the floor surface from a kneeling position in order to remove old paint or old adhesive material. Due to the small surface area that can be ground or sanded at any particular time, the use of hand-manipulated grinders is extremely time consuming.

Also, the operator must manipulate the device from a stooped position, or more typically while resting on hands and knees. This is an extremely uncomfortable and tiring position in which to work. Furthermore, operation of hand-manipulated machines in this manner requires the operator's face to be positioned close to the surface area of the floor being ground. This subjects the operator to inhalation at close quarters of a large amount of ground floor surfacing particulate matter, grit, and dust. This aggravates the operator's discomfort, and additionally creates a health hazard to the machine operator.

There has been a considerable need for larger machines that have larger grinding pads or blades. Such machines can be constructed in the approximate size and shape of a power lawnmower, and can be manipulated by an operator from a standing position. These larger, wheeled floor grinding machines can cover a much larger floor area within a given time, and are much easier to operate than hand-manipulated grinders. However, the use of a mobile, wheeled floor grinding machine pushed using an operator handle is often impractical due to the considerable danger that high speed rotation of such a large blade or pad presents. For example, the high speed rotation of a thirty inch diameter blade presents a considerable safety hazard. If the blade strikes a hard object the wrong way, it can shatter and send broken portions of the blade flying with dangerous and even deadly effect.

Power consumption for such a machine, the size of the machine itself, and the cost of blades which may be utilized with such a machines are other factors that dictate against the use of a machine constructed with such a large grinding element. Thus, although the need for a large floor grinding machine that can be operated from a standing position has existed for many years, conventional devices of this type have been simply too dangerous or too expensive to gain significant commercial acceptance.

SUMMARY OF THE INVENTION

The present invention is a floor grinding machine that dramatically reduces the problems that have characterized conventional large floor surface refinishing machines. The present invention combines the advantages of a large, wheeled floor resurfacing machine while eliminating the disadvantages historically associated therewith. The floor resurfacing machine of the present invention can be manipulated by an operator from a standing position and can finish a large floor surface, for example thirty inches in diameter, at any given position. However, the present invention does not employ a large, high speed blade having this diameter. To the contrary, the present invention employs a plurality of smaller grinders, comparable in size to the grinding elements utilized in hand-manipulated grinding machines. These grinders are mounted at spatially separated locations on a large, but relatively slowly rotating grinder frame.

The multielement grinding machine of the present invention uses the commercially available styles of five inch, seven, inch or ten inch grinding blades and pads that are currently utilized separately on hand-manipulated grinders. Several of these relatively small, commercially available grinding blades are operated at a high speed on a plate or grinder mounting frame which is also rotated but at a much lower speed.

The invention is particular advantageous since it operates both the relatively small grinder elements and the relatively large grinder mounting frame from a single power source and through a single main driving shaft.

The grinder mounting frame employed in the invention is preferably configured as a combined gearbox that includes elements that operate from a main drive shaft to concurrently increase the speed of the shafts of the grinding elements and at the same time reduce the speed of rotation of the grinder mounting frame or gearbox. For example, each of a plurality of grinding elements may be operated at an angular speed of rotation of eighty-five hundred revolutions per minute, while the plate or grinder mounting frame upon which these grinding elements are mounted rotates at a speed of only about fifty revolutions per minute.

The advantage of such a grinding device is that it may be manipulated with the ease and safety of a typical, hand-held, seven inch grinder. However, because the system employs a plurality of grinding blades and since the grinding units carrying these blades are all mounted on a common, relatively slowly rotating grinder mounting frame, the machine resurfaces over swaths much larger in area than is possible utilizing hand-held grinders. As a consequence, the machine can be operated to achieve a much higher rate of productivity.

Preferably also the bearing housing that carries all of the rotating components is supported on a wheeled chassis by gimbals. As a consequence, the entire operating assembly accommodates uneven areas in the floor surface so that the faces of the grinding units remain in full face-to-face contact with the floor and grind the surface clean of any slight imperfections. Because the grinder mounting frame in effect floats relative to the chassis of the machine, the edges of the grinding elements remain in full surface contact with the floor and are not lifted off of the floor or oriented so as to dig into the floor as the wheels of the device travel across uneven areas of the floor.

In one broad aspect the present invention may be considered to be a multidisc floor grinding apparatus comprising: a chassis supported by wheels to roll across a floor; a bearing housing supported by gimbals on the chassis; a main drive shaft rotatably mounted in the bearing housing to project downwardly therefrom; an annular grinder mounting frame extending radially about the main drive shaft and mounted coaxially therewith for rotation relative thereto; a grinding mounting frame drive mechanism by which the main drive shaft rotates the grinder mounting frame thereabout at a reduced speed relative thereto; a plurality of grinders supported by the grinder mounting frame for rotation relative thereto at respective axes parallel to and radially displaced at a common grinder axis displacement distance from the main drive shaft; a grinder drive mechanism coupled to rotate the grinders about their respective axes at a greater angular speed than the grinder mounting frame rotates about the main drive shaft; and a power source mounted on the chassis and coupled to drive the grinder mounting frame and the plurality of grinders by rotating the main drive shaft.

The system is constructed so that the entire operating mechanism is suspended relative to the chassis by the gimbals that support the bearing housing. The bearing housing then supports the main drive shaft which remains in a substantially vertical orientation, although it can change slightly in its orientation to accommodate uneven floor surfaces. Bearings interposed between the main drive shaft and the grinder mounting frame permit relative rotation between the grinder mounting frame and the main drive shaft.

The grinder mounting frame drive mechanism may include a transfer shaft mounted in the grinder mounting frame and aligned along a transfer shaft axis that is parallel to and radially displaced from the main drive shaft axis. The transfer shaft is mounted in bearings on the grinder mounting frame so that it can rotate relative thereto. In the preferred embodiment the transfer shaft carries a grinder mounting frame pinion sprocket, while a much larger, base sprocket is secured to the bearing housing. The grinder mounting frame pinion sprocket is rotatably mounted to the grinder mounting frame, since it is clamped or otherwise firmly secured to the transfer shaft. The grinder mounting frame pinion sprocket has a much smaller pitch diameter than the base sprocket. An endless drive chain is engaged with both the base sprocket and the grinder mounting frame pinion sprocket.

The grinder mounting frame drive mechanism also includes an orbital power transfer mechanism coupled to the main drive shaft and to the transfer shaft to transfer power from the main drive shaft to the grinder mounting frame pinion sprocket. The orbital power transfer mechanism preferably includes an intermediate shaft secured to the grinder mounting frame for rotation relative thereto. The transfer shaft, the intermediate shaft, and the main drive shaft have gears mounted thereon which are in meshed engagement. These speed reducing gears drive the grinder mounting frame in rotation at just a small fraction of the speed of rotation of the main drive shaft.

The first gear on the main drive shaft is in meshed engagement with a second and larger gear on the intermediate shaft and rotates the intermediate shaft at a reduced speed relative to the main drive shaft, since the pitch diameter of the first gear is less than that of the second. A third small transfer gear on the intermediate shaft is engaged with a much larger transfer gear on the transfer shaft. Power transferred from the main drive shaft through the transfer gears causes the transfer shaft to rotate at considerably reduced angular velocity relative to the speed of rotation of the main drive shaft. The rotation of the transfer shaft causes the grinder mounting frame pinion sprocket to rotate as well.

An endless chain is engaged with the teeth on the periphery of the base sprocket, which is coaxially mounted relative to the main drive shaft, but is firmly secured relative to the bearing housing. The chain is also engaged with the teeth of the grinder mounting frame pinion sprocket, which is located at a spaced radial distance from the main drive shaft. The rotation of the grinder mounting frame pinion sprocket causes the pinion sprocket to advance along the links of the chain that is also engaged with the fixed base sprocket. The rotation and advancement of the grinder mounting frame pinion sprocket exerts a force on the transfer axle that carries the transfer axle in a orbital path about the main drive shaft axis.

Since the transfer shaft is mounted in bearings in the grinder mounting frame, the force rotating the pinion sprocket is transmitted to the grinder mounting frame to rotate the grinder mounting frame about the main drive shaft axis, but at a greatly reduced speed compared to the speed of rotation of the main drive shaft. The power transfer elements of the grinder mounting frame drive mechanism preferably effectuate a speed reduction of at least twenty-five to one, and preferably about forty to one, from the main drive shaft to the grinder mounting frame. Therefore, if the main drive shaft rotates at a speed of about two thousand rpm, the grinder mounting frame will rotate at a speed of about fifty rpm.

All of the several grinders that are mounted in the grinding mounting frame are also powered from the main drive shaft. The grinder drive mechanism preferably includes a primary grinder power transfer gear coupled to the main drive shaft and rotatable therewith. Separate grinder power take-off gears are coupled to each of the plurality of grinders for driving the grinders separably in rotation about their own axes. All of the grinder power take-off gears are meshed with the primary grinder power transfer gear. To achieve the required speed increase, the primary grinder power transfer gear preferably has a pitch diameter considerably greater than the pitch diameters of the grinder power take-off gears. The pitch diameter of the primary grinder power transfer gear is preferably at least about twice the pitch diameter of the grinder power take-off gears. If the ratio of the pitch diameter of the primary grinder power transfer gear to the pitch diameters of each of the power take-off gears is about four to one and the main drive shaft rotates at a speed of about two thousand rpm, each of the grinders will be rotated at a speed of about eight thousand rpm.

Since the bearing housing is gimbaled relative to the chassis the power source is preferably coupled to the main drive shaft with a flexible coupling so that the power source can be firmly secured to the chassis. For example, a drive pulley may be coupled to the main drive shaft and driven through an endless belt by the power source, which may be an electrical or gasoline driven motor. Due to the gimbaled mounting of the bearing housing, the driven pulley on the main drive shaft will vary in orientation slightly from a horizontal alignment as the floor grinding apparatus travels across uneven locations on the floor. However, the departure of the pulley on the main drive shaft from horizontal alignment is relatively slight, and can be accommodated by flexure of the driving belt.

In another broad aspect, the invention may be considered to be a multidisc floor grinding machine comprising: a chassis supported upon a plurality of wheels for movement across a floor; a bearing housing supported by the chassis upon a bearing housing support axis oriented parallel to the floor; a main drive shaft mounted on the bearing housing for rotation relative thereto about a main drive shaft axis; a grinder mounting frame located beneath and oriented parallel to the bearing support axis and oriented perpendicular to the drive shaft axis for rotation relative thereto about a grinder mounting frame axis oriented perpendicular to and intersecting the bearing housing support axis; a grinder mounting frame drive mechanism that couples the main drive shaft to drive the grinder mounting frame in rotation at a reduced angular velocity relative to that of the main drive shaft; a plurality of grinders each having a grinding element and a grinder axis oriented parallel to the grinder mounting frame axis, wherein the grinders are all mounted for rotation on the grinder frame in spaced separation from each other and from the grinder mounting frame axis; a grinder drive mechanism coupling the main drive shaft to the plurality of grinders to drive the grinder elements at an increased angular velocity relative to that of the grinder mounting frame; and a power source coupled to drive the main drive shaft in rotation.

In still another broad aspect the invention may be described as a multidisc floor grinder comprising: a chassis; wheels supporting the chassis to carry it across a floor surface; a bearing housing mounted by gimbals on the chassis for movement relative thereto about a bearing housing axis that is parallel to the floor; a main drive shaft supported by bearings in the bearing housing to depend from the bearing housing and rotatable thereto about a main drive shaft axis that is perpendicular to and intersects the bearing housing axis; a grinder mounting frame supported by the main drive shaft and extending radially therefrom for rotation about the main drive shaft axis relative to the main drive shaft; a grinder mounting frame drive mechanism coupled between the main drive shaft and the grinder mounting frame to drive the grinder mounting frame in rotation relative to the chassis at a speed reduced from that of the main drive shaft; a plurality of grinders mounted on the grinder mounting frame for rotation relative thereto about grinder axes that are parallel to and radially displaced from the main drive shaft axis, and wherein each of the grinders is equipped with a grinder element depending therefrom which has a radius smaller than the distance of displacement of the grinder axes from the main drive shaft axis; a grinder drive mechanism coupled between the main drive shaft and the grinders to rotate the grinder elements about their respective grinder axes at a speed greater than that of the main drive shaft; a power source mounted on the chassis; and a main drive mechanism coupled between the power source and the main drive shaft to rotate the main drive shaft about the main drive shaft axis while permitting movement of the bearing housing in the gimbals.

The invention may be described with greater clarity and particularity with respect to the accompanying drawings.

DESCRIPTION OF THE EMBODIMENT

Figure 1:
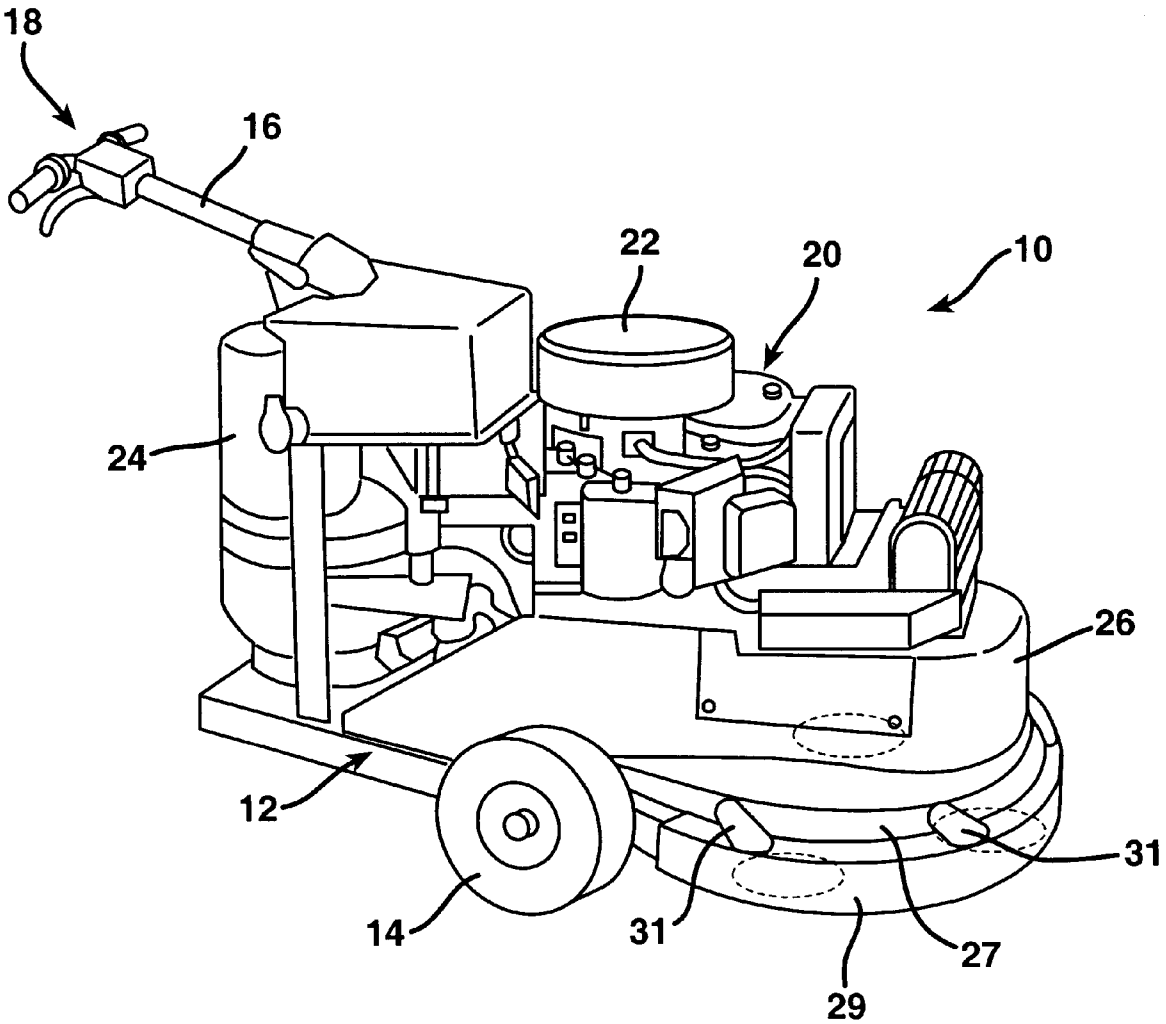
FIG. 1 is a perspective view of a multidisc floor grinder machine according to the invention.

FIG. 1 shows in perspective a multidisc floor grinding machine 10 constructed according to the invention. The grinding machine 10 is comprised of a chassis, indicated generally at 12, supported upon a pair of wheels 14 that are coaxially aligned with each other on the opposite sides of the chassis 12. The grinding machine 10 also includes a handle 16 that is secured to the chassis 12 and which includes operating control levers and switches indicated generally at 18. The floor grinding machine 10 has a conventional gasoline-driven engine 20 with an air filter 22 thereatop. The engine 20 drives a motor 24, which serves as the power source for the operating components of the floor grinder. These components are largely concealed from view by an upper aluminum cover 26 and a lower aluminum cover 27 which are provided for cosmetic purposes. A confining dust collection shroud or skirt 29 extends down from the lower cover 27 to the floor to confine and collect dust, dirt grit, and other debris. Suction ducts 31 lead from the dust collection skirt 29 to a conventional vacuum source (not visible).

Figure 2:
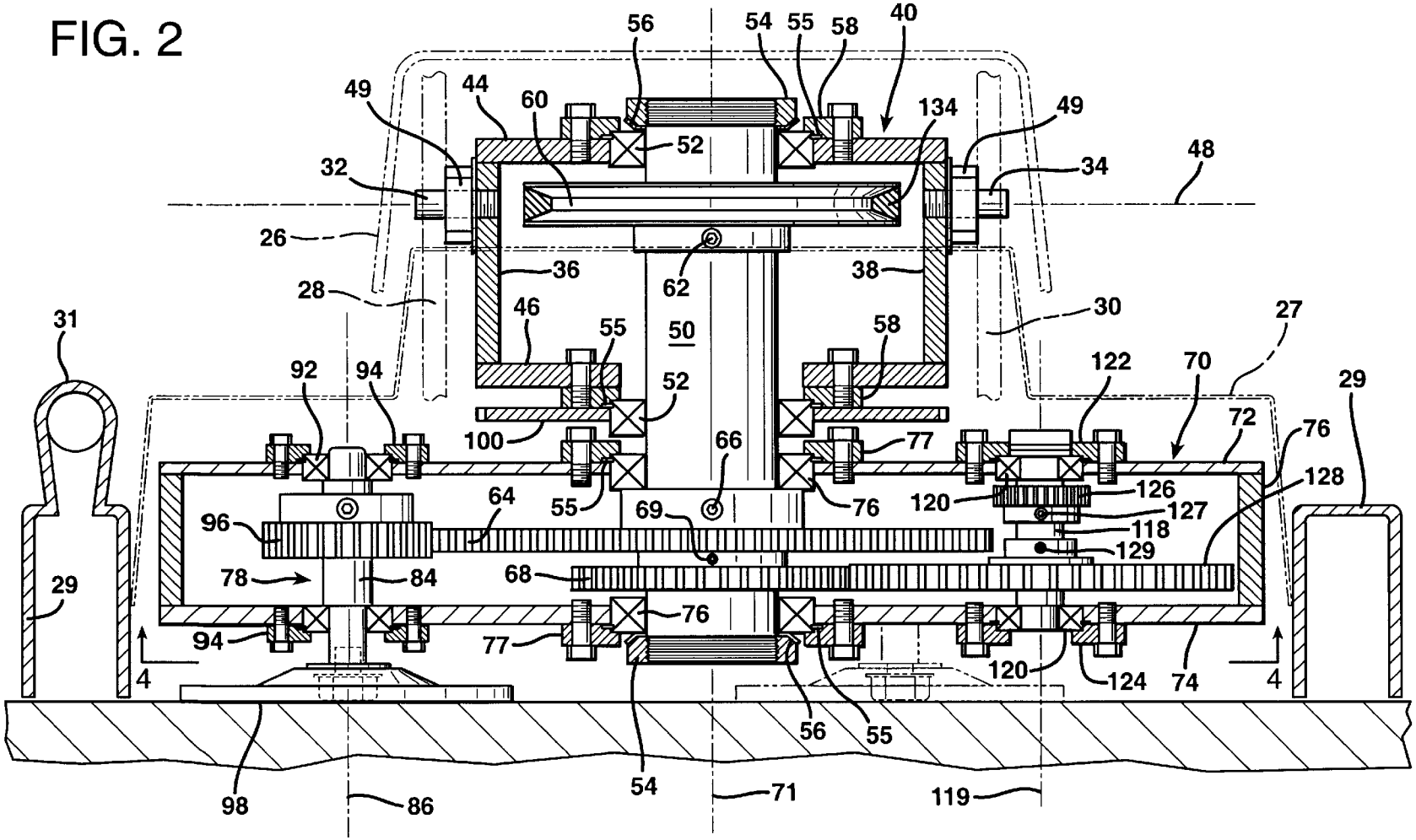
FIG. 2 is a sectional elevational view of the operating components of the multidisc floor grinding machine of FIG. 1 taken along the lines 2—2 of FIG. 5.
Figure 6:
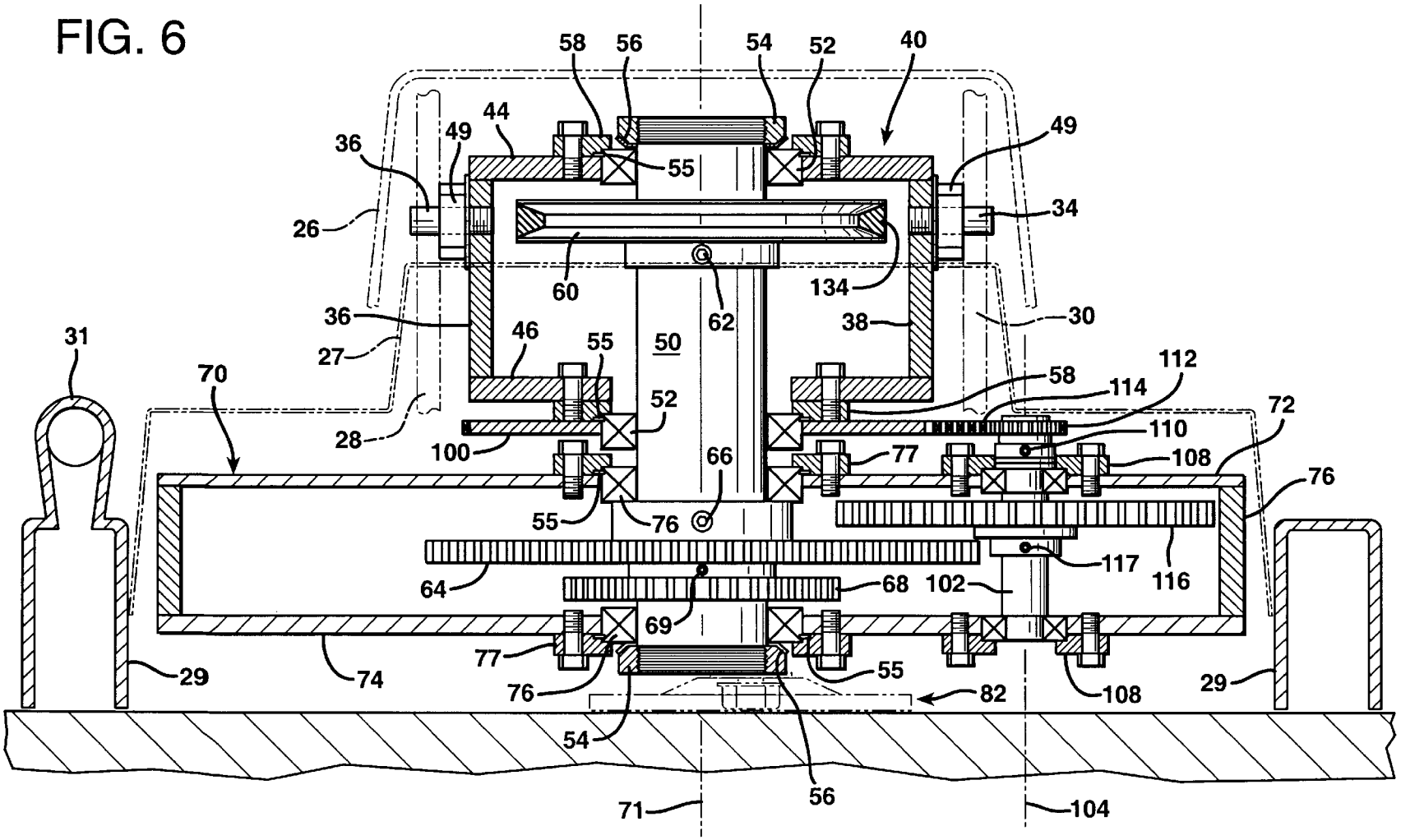
FIG. 6 is a sectional elevational view taken along the lines 6—6 of FIG. 5.

The operating components of the floor grinder 10 are best depicted in FIGS. 2 and 6. The chassis 12 of the machine 10 includes, on both of its opposite sides, forward of the wheels 14 and remote from the handle 16, a pair of upright gimbal mounting posts 28 and 30, indicated in phantom in FIGS. 2 and 6. The gimbal mounting posts 28 and 30 are rigidly secured to the remaining structure of the chassis 12 and support a pair of stub axles 32 and 34 that are threadably engaged in internally tapped, coaxially aligned bores in the side walls 36 and 38 of a generally box-shaped bearing housing 40, illustrated in perspective in FIG. 3. The bearing housing 40 is formed with a transverse front wall 42 that is rigidly secured to the upright fore and aft side walls 36 and 38. A rectangular-shaped top plate 44 (partially broken away in FIG. 3) and a corresponding bottom plate 46 are also rigidly secured transversely across the front end wall 42 and the fore and aft side walls 36 and 38. The box-shaped bearing housing 40 is open at the rear so as to permit the passage of an endless, flexible vee-belt 134 that is coupled to the power source, namely the motor pulley 132 of the motor 24.

The stub axles 32 and 34 extend outwardly into coaxially aligned openings in the gimbal mounting posts 28 and 30. The bearing housing 40 can thereby rotate freely about the generally horizontal, transverse bearing housing support axis 48 along which the stub axles 32 and 34 are aligned. The inner ends of the stub axles 32 and 34 are externally threaded and are threadably engaged in internally tapped, coaxially aligned bores in the bearing housing side walls 36 and 38, respectively. Nuts 49 are welded or otherwise rigidly secured to both the stub axles 32 and 34 so as to allow the stub axles 32 and 34 to be firmly attached to the fore and aft side walls 36 and 38 of the bearing housing 40. The stub axles 32 and 34 thereby support the bearing housing 40 on the chassis 12 by the gimbaled connections in the gimbal mounting posts 28 and 30. The gimbaled connections allow the bearing housing 40 to rock in a fore and aft direction of rotatable movement about the bearing housing support axis 48, which is parallel to the floor.

A cylindrical main drive shaft 50 is provided and is mounted for rotation by means of bearings 52 in the top plate 44 and the bottom plate 46 of the bearing housing 40. The main drive shaft 50 rotates about its own longitudinal axis 71, which is perpendicular to and intersects the bearing housing support axis 48. The main drive shaft 50 preferably has an outer diameter of about 3.85 inches and is externally threaded at both of its opposite ends. Thrust bearing nuts 54 are threadably engaged and secured to both the upper and lower threaded ends of the main drive shaft 50. Thrust bearings 56 are interposed between the thrust bearing nuts 54 and the annular bearings 52 within which the main drive shaft 50 turns. Retaining plates 58 are secured by bolts to both the top plate 44 and to the bottom plate 46 of the bearing housing 40 and reside in abutment against the bearing rings 52 to prevent longitudinal movement of the main drive shaft 50 relative to the bearing housing 40, yet permit high speed rotation of the main drive shaft 50 relative to the bearing housing 40. The retaining plates 58 each have a square outer perimeter with a central circular opening therewithin. The retaining plates 58 are fastened by bolts at their corners spaced 5.6 inches apart from each other. The retaining plates 58 have snap rings 55 that engage and longitudinally immobilize the annular bearings 52. The snap rings 55 have a circumferential span of about 355°.

The main drive shaft 50 is rotatably mounted in the bearing housing 40 and projects upwardly and downwardly therefrom through central, coaxially aligned openings in the bearing housing top plate 44 and bottom plate 46, as illustrated in FIGS. 2 and 6. Near the upper end of the main drive shaft 50, but within the bearing housing 40, a main drive shaft vee-belt pulley 60 is secured by means an allen head set screw 62 that acts radially through a depending collar on the underside of the belt pulley 60.

Beneath the bearing housing 40 the main drive shaft 50 is provided with a large primary grinder power spur gear 64 having an upwardly extending attachment collar through which another allen head set screw 66 is fastened. The allen head set screw 66 locks the primary grinder power gear 64 to the outer surface of the main drive shaft 50 for rotation therewith. The gear 64 preferably has a pitch diameter of about twelve inches.

Beneath the primary grinder power gear 64 the main drive shaft 50 is provided with a first orbital power transfer gear 68 that has an upwardly projecting fastening collar through which another allen head set screw 69 is engaged. The set screw 69 clamps the first orbital power transfer gear 68 to the outer surface of the main drive shaft 50. The first orbital power transfer gear 68 preferably has a pitch diameter of six inches.

The multidisc floor grinding machine 10 also includes an annular grinder mounting frame 70 that extends radially about the main drive shaft 50 and is mounted coaxially therewith for rotation about the main drive shaft axis 71. The grinder mounting frame 70 is a generally disc-shaped structure with central, axial openings defined therethrough. The grinder mounting frame 70 is formed with a laterally expansive, annular upper mounting plate 72 and a corresponding lower annular mounting plate 74. The upper and lower mounting plates 72 and 74 are secured together about their perimeters by a cylindrical grinder mounting frame housing wall 76 that is rigidly secured to the upper and lower plates 72 and 74 by some conventional fastening means such as bolts 81, visible in FIG. 4.

Figure 4:
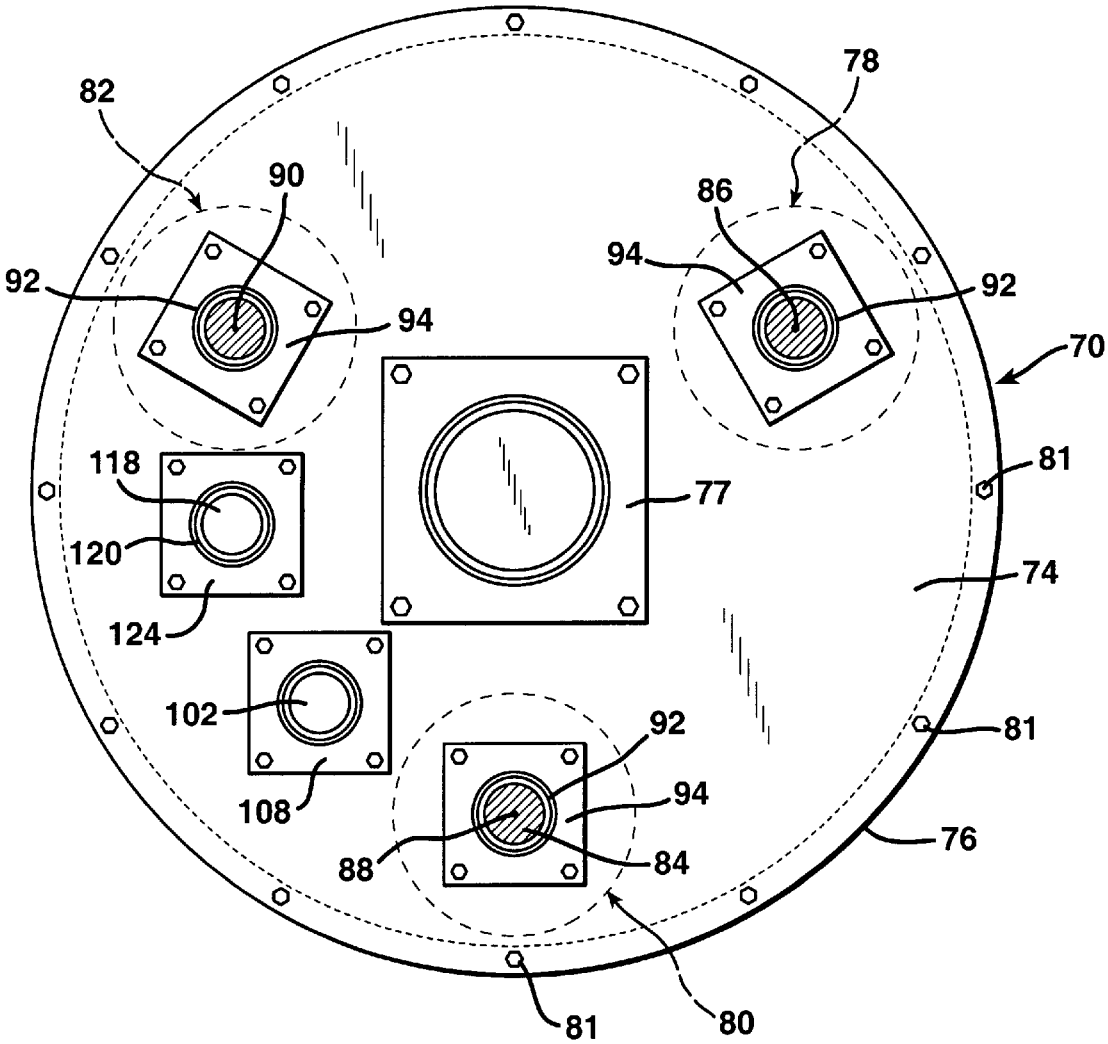
FIG. 4 is a bottom plan view taken along the lines 4—4 of FIG. 2.

At the central, axial openings in the upper grinder mounting plate 72 and the lower grinding mounting plate 74 a pair of bearing rings 76 are provided. The bearing rings 76 are interposed between the main drive shaft 50 and the structure of the grinder mounting frame 70. Retaining plates 77 are bolted to both the upper grinder mounting frame plate 72 and the lower grinder mounting frame plate 74 as illustrated in FIGS. 2, 4, and 6 to prevent longitudinal movement, but permit rotational movement between the grinder mounting frame 70 and the main drive shaft 50. The retaining plates 77 are the same size as the retaining plates 58 and are bolted to the grinder mounting frame 70 with the same bolt spacing as the retaining plates 58. The retaining plates 77 also have annular snap rings 55 that engage and longitudinally immobilize the annular bearings 76.

A plurality of grinders 78, 80, and 82 are provided in the multidisc floor grinding machine 10 and are arranged at equally spaced intervals about the main drive shaft axis 71. The grinders 78, 80, and 82 are supported by the grinder mounting frame 70 for rotation relative thereto. While any plural number of grinders may be employed, in the preferred embodiment there are three grinders 78, 80, and 82 spaced at one hundred twenty degree intervals over the expanse of the grinder mounting frame 70.

Each of the grinders 78, 80, and 82 includes a grinder shaft 84 one and one-half inches in diameter that is oriented parallel to and radially displaced from the main drive shaft 50. The grinder shafts 84 of each of the grinders 78, 80, and 82 rotate about their respective grinder shaft axes 86, 88, and 90. The grinder shaft axes 86, 88, and 90 are parallel to the main drive shaft axis 71 and are located at a common grinder axis displacement distance therefrom. In the embodiment illustrated the grinder axes 86, 88, and 90 are located at a distance of 7.750 inches from the main drive shaft axis 71.

Each of the grinder shafts 84 is supported for rotation within bearing rings 92 located at openings in both the top grinder mounting frame plate 72 and the bottom grinder mounting frame plate 74. The bearing rings 92 are also held in place by annular retaining plates 94 that are bolted to both the top grinder mounting frame plate 72 and the bottom grinder mounting frame plate 74 by bolts spaced 2.75 inches apart, as best illustrated in FIG. 4.

Each grinder shaft 84 has a separate grinder power take-off gear 96. The grinder power take-off gears 96 are spur gears having pitch diameters of five inches. The grinder power take-off gears 96 reside in coplanar relationship and in meshed engagement with the primary grinder power gear 64 that is rigidly secured to the main drive shaft 50.

At the lower extremity of each of the grinders 78, 80, and 82, a grinding element 98 is mounted. The grinding element 98 may be a conventional five inch diameter, seven inch diameter, or ten inch diameter blade of the type which is utilized on commercially available, hand manipulated grinding machines. Alternatively, the grinding elements 98 may be grit covered discs which are commercially available in the same five inch, seven inch, and ten inch diameters. In either case, either a blade or a grit covered disc is fastened as a grinding element to the lower extremity of the grinder shaft 84 of each of the grinders 78, 80, and 82.

A large base sprocket 100 having a pitch diameter of fifteen inches is rigidly secured to the bottom plate 46 at the underside of the bearing housing 40 by bolts, welding, or other conventional means. The base sprocket 100 is a large, annular sprocket that has a central opening therethrough that accommodates the bearing ring 52 within which the main drive shaft 50 is journaled.

The grinder mounting frame 70 carries a transfer shaft 102 that is oriented parallel to and radially displaced from the drive shaft 50. Preferably, the transfer shaft axis 104 of the transfer shaft 102 is radially displaced from the main drive shaft axis 71 a distance of about 9.5 inches. The transfer shaft 102 is journaled for rotation relative to the grinder mounting frame 70 in bearing rings 106 and is best illustrated in FIG. 6. The bearing rings 106 are held in position and the transfer shaft 102 is captured by means of annular bearing retaining plates 108. The bearing plates 108 are bolted at their corners to the upper grinder mounting frame plate 72 and the lower grinder mounting frame plate 74 by bolts spaced 2.75 inches from each other.

The upper end of the transfer axle 102 protrudes above the grinder mounting frame 70 a sufficient distance for a mounting frame pinion sprocket 112 to be attached thereto. The pitch diameter of the mounting frame pinion sprocket 112 is preferably one and one-half inches. The grinder mounting frame pinion sprocket 112 has a depending collar that is clamped onto the upper end of the transfer shaft axle 102 by means of an allen head set screw 110 in a conventional manner. An endless drive chain 114 is looped about and engaged with the teeth of both the base sprocket 100 and the teeth of the grinder mounting frame pinion sprocket 112.

Below the grinder mounting frame pinion sprocket 112 and within the confines of the grinder mounting frame 70, the transfer shaft 102 carries a spur gear 116 that is preferably 8.5 inches in diameter. The spur gear 116 is secured to rotate with the transfer shaft 102 by means of an allen head set screw 117 that clamps a collar depending from the underside of the gear 116 to the transfer shaft 102 in a conventional manner.

The grinder mounting frame drive mechanism also includes an intermediate speed reduction shaft 118 that is carried by means of bearings 120 in the grinder mounting frame 70. The intermediate speed reduction shaft 118 is captured within the grinder mounting frame 70 by means of annular retaining plates 122 that are bolted to the top and bottom plates 72 and 74 of the grinding mounting frame 70, as illustrated in FIGS. 2 and 4. The axis 119 of the intermediate speed reduction shaft 118 is parallel to and radially displaced from the main drive shaft axis 71, preferably at a distance of seven inches therefrom. The intermediate speed reduction shaft 118 has a small 2.5 inch pitch diameter upper spur gear 126 and a larger, eight and a half inch diameter lower spur gear 128. Both of the intermediate gears 126 and 128 have collars which are respectively secured to the intermediate speed reduction shaft 118 by means of allen head set screws 127 and 129 in a conventional manner. The intermediate speed reduction shaft 118 and its gears 126 and 128 are visible in FIG. 2. The gear 128 on the intermediate shaft 118 lies in coplanar relationship with and is engaged with the gear 68 that is secured to the main drive shaft 50.

The main drive shaft 50 rotates at a speed of twenty-five hundred revolutions per minute. The first orbital power transfer gear 68 is in meshed engagement with the intermediate gear 128, thereby reducing the speed of the intermediate speed reduction shaft 118 relative to the speed of rotation of the main drive shaft 50. The meshed engagement of the small gear 126 on the intermediate shaft 118 with the much larger gear 116 on the transfer shaft 102 reduces the speed of the transfer shaft 102 relative to the main drive shaft 50 still further down to about five hundred fifty rpm. The engagement of the small sprocket 112 on the transfer shaft 102 with the much larger fixed base gear 100 by means of the chain 114 effectuates a further ten to one speed reduction, so that the transfer shaft 118 is pulled in orbital motion about the axis 71 of the main drive shaft 50 at a speed of only about fifty rpm. The grinder mounting frame pinion sprocket 112 also rotates relative to the base sprocket 100 to carry the grinder mounting frame 70 in rotation about the main drive shaft 50 and its axis 71. Since the transfer shaft 102 is rotatably secured by the bearings 106 and retaining plates 108 to the grinder mounting frame 70, the advance of the sprocket 112 along the chain 114 causes the entire grinder mounting frame 70 to rotate at a speed of about fifty rpm about the main drive shaft axis 71. The relatively slow rotation of the grinder mounting frame 70 about the main drive shaft axis 71 carries with it the several grinders 98, which are rotating at a much higher speed, approximately eighty-five hundred rpm about their respective axes 86, 88, and 90.

The gears 68, 128, 126, and 116 on the main drive shaft 50, the intermediate shaft 118, and the transfer shaft 102 are in meshed engagement. In the orbital power transfer drive line the gear 68 secured to the main drive shaft 50 drives the gear 128 thereby rotating the intermediate shaft 118. The gear 126 on the intermediate shaft 118 drives the gear 116 on the transfer shaft 102. The rotation of the transfer shaft 102 rotates the sprocket 112 relative to the base sprocket 100. The advancement of the sprocket 112 along the endless chain 114 carries the grinder mounting frame 70 in rotation about the main drive shaft 50.

The grinder mounting frame 70 is coaxially mounted on the main drive shaft 50. The grinder frame bearings 76 are interposed between the main drive shaft 50 and the grinder mounting frame 70. The grinder mounting frame drive mechanism, which includes the meshed gears 68, 128, 126, and 116 and the sprockets 112 and 100 coupled together by the endless chain 114 serve as speed reducing components. The main drive shaft 50 thereby drives the grinder mounting frame 70 in rotation at a small fraction of its own speed of rotation. The power transfer elements or components of the grinder mounting frame drive mechanism effectuate a speed reduction of at least twenty-five to one, and preferably about forty to one, from the main drive shaft 50 to the grinder mounting frame 70.

The large, primary grinder power gear 64 that is coupled to the main drive shaft 50 and which is rotatable therewith is in coplanar relationship with all of the separate grinder power take-off gears 96. The power take-off gears 96 are coupled to their respective grinder shafts 84 for driving the three grinders 78, 80, and 82 in rotation. The grinder power take-off gears 96 on the grinder shafts 84 are all meshed with the primary grinder power transfer gear 64. The primary grinder power transfer gear 64 has a pitch diameter greater than the pitch diameters of the grinder power take-off gears 96 by a factor of at least about two to one, and preferably about four to one.

Figure 5:
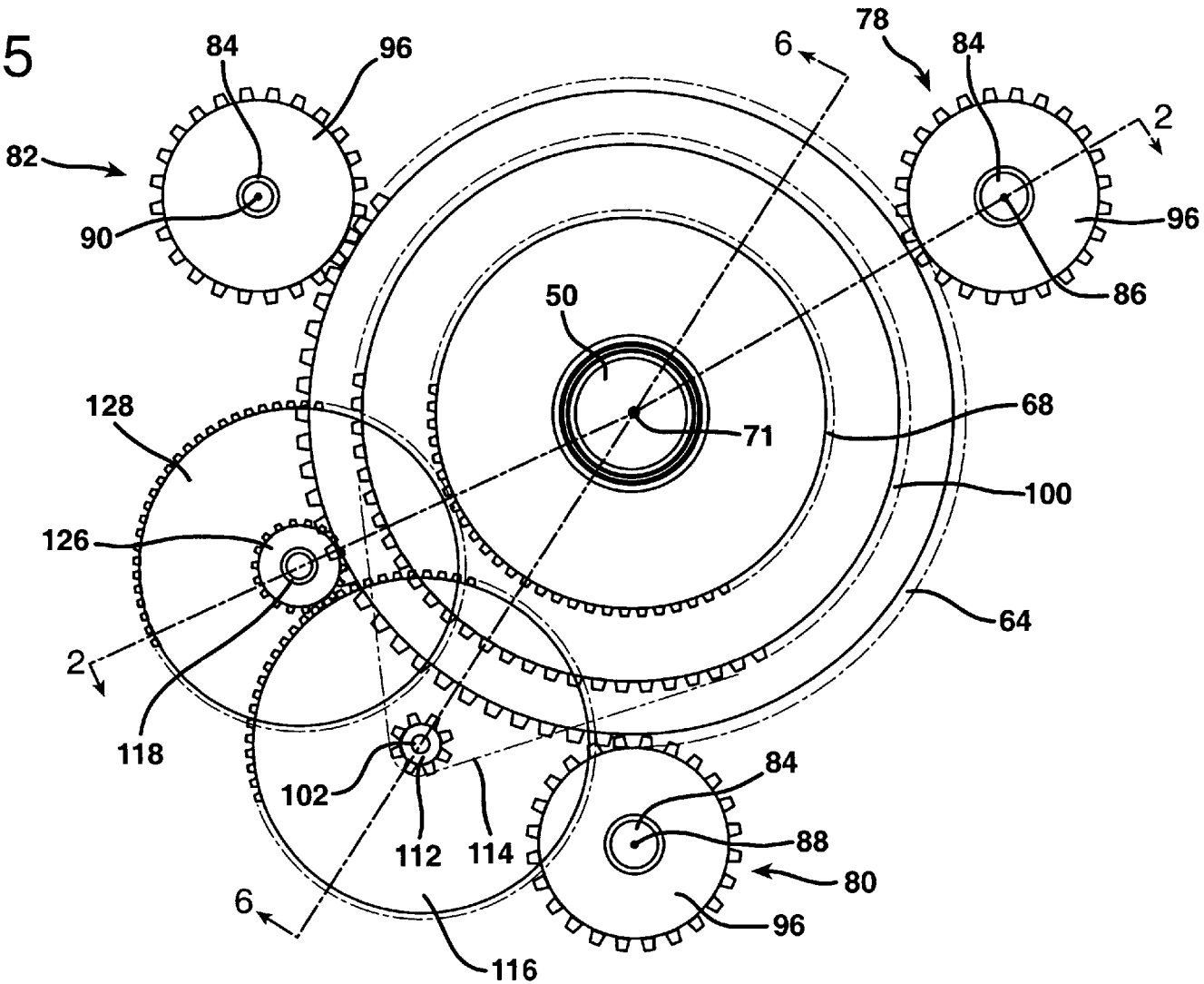
FIG. 5 is a diagrammatic bottom plan view illustrating the operating components of the grinder mounting frame drive mechanism and the grinder drive mechanism.

The meshed engagement of the gears 64 and 96 in the grinder power drive line are illustrated in FIG. 5. The meshed engagement of the gears 68, 128, 126, and 116 and the engagement of the sprockets 112 and 100 by means of the endless chain 114 are also illustrated in FIG. 5.

Figure 3:
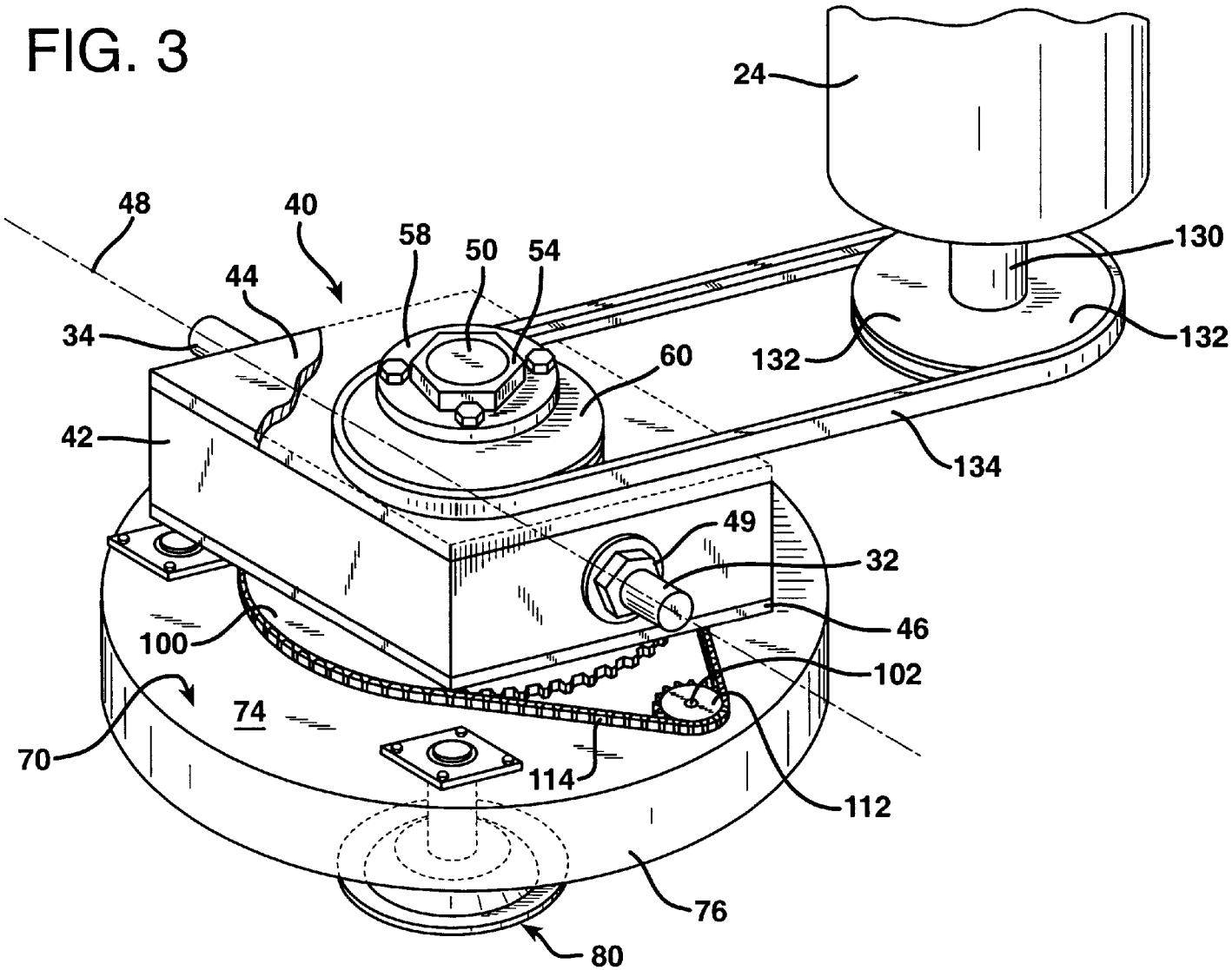
FIG. 3 is a perspective detail illustrating the power source, the bearing housing, and the grinder mounting frame of the multidisc floor grinder of FIG. 1.

The driving connection from the motor 24 to the main drive shaft 50 is best illustrated in FIG. 3. As shown in that drawing figure, the motor output shaft 130 drives the motor pulley 132, which in turn drives an endless vee-belt 134. The vee-belt 134 in turn drives the pulley 60 that is secured to the main drive shaft 50 within the bearing housing 40. As the grinders 78, 80, and 82 encounter uneven locations on the floor, the bearing housing 40 will swivel about the stub axles 32 and 34 relative to the chassis 12 in a fore and aft direction. This allows the grinders 78, 80, and 82 to accommodate uneven surfaces on the floor. The vee-belt 134 is flexible enough to accommodate the relative small deviations of the main drive shaft axis 71 from true vertical alignment while remaining engaged with the pulleys 60 and 132.

The chassis 12 carries an annular dust collection shroud or skirt 29 that includes suction ducts 31 that are connected to a vacuum source that is also operated by the motor 24. As the grinders 78, 80, and 82 grind away paint or other particulates, the dust collection shroud 13 confines the particulates so that they can be sucked to a dust collection bag in a conventional manner, thereby reducing the health hazard to the machine operator. The use of the dust collection system also reduces the likelihood that airborne particulate matter will get into other equipment in the vicinity, which could otherwise lead to malfunction of that equipment.

It is to be understood that different operating components from those depicted in the preferred embodiment of the invention may be employed in the grinder mounting frame drive mechanism, as well as in the grinder drive mechanism. Also, different speed reduction systems and ratios may be employed in rotating the grinder mounting frame relative to the main drive shaft. Likewise, different speed increasing systems and ratios may be employed in operating the grinders from the main drive shaft. In addition, different flexible coupling mechanisms and different power sources may be employed in rotating the main drive shaft. Accordingly, the scope of the invention should not be construed as limited to the specific embodiment depicted and described, as considerable variations and modifications of that embodiment will be come readily apparent to those skilled in the art.

We claim:

1. A multidisc floor grinding apparatus comprising:

a chassis supported by wheels to roll across a floor, a bearing housing supported by gimbals on said chassis, a main drive shaft, rotatably mounted in said bearing housing to project downwardly therefrom, an annular grinder mounting frame extending radially about said main drive shaft and mounted coaxially therewith for rotation relative thereto;

a grinder mounting frame drive mechanism by which said main drive shaft rotates said grinder mounting frame thereabout at a reduced speed relative thereto, a plurality of grinders supported by said grinder mounting frame for rotation relative thereto at respective axes parallel to and radially displaced at a common grinder axis displacement distance from said main drive shaft, a grinder drive mechanism coupled to rotate said grinders about their respective axes at a greater angular speed than said grinder mounting frame rotates about said main drive shaft, and a power source mounted on said chassis and coupled to drive said grinder mounting frame and said plurality of grinders by rotating said main drive shaft;

further characterized in that said grinder mounting frame drive mechanism is comprised of a base sprocket secured to said bearing housing, a grinder mounting frame pinion sprocket rotatably mounted to said grinder mounting frame and having a smaller pitch diameter than said base sprocket, an endless drive chain engaged with both said base sprocket and said grinder mounting frame pinion sprocket, a transfer shaft carrying said grinder mounting frame pinion sprocket and oriented parallel to said main drive shaft and rotatably mounted on said grinder mounting frame, and an orbital power transfer mechanism coupled to said main drive shaft and to said transfer shaft to transfer power from said main drive shaft to said grinder mounting frame pinion sprocket, whereby said grinder mounting frame pinion sprocket rotates relative to said base sprocket and orbits about said main drive shaft to carry said grinder mounting frame in rotation about said main drive shaft.

2. A multidisc floor grinding apparatus according to claim 1 wherein said orbital power transfer mechanism includes an intermediate shaft secured to said grinder mounting frame for rotation relative thereto, and said transfer shaft, said intermediate shaft, and said main drive shaft have gears mounted thereon which are in meshed engagement whereby said main drive shaft drives said grinder mounting frame in rotation at a fraction of its own speed of rotation.

3. A multidisc floor grinding apparatus according to claim 1 wherein said grinder mounting frame drive mechanism includes power transfer elements that effectuate a speed reduction of at least twenty-five to one from said main drive shaft to said grinder mounting frame.

4. A multidisc floor grinding apparatus according to claim 1 wherein said grinder mounting frame drive mechanism includes speed reducing components that rotate said grinder mounting frame with a speed reduction ratio of about forty to one.

5. A multidisc floor grinding apparatus according to claim 1 wherein said grinder drive mechanism includes a primary grinder power gear coupled to said main drive shaft and rotatable therewith, and a separate grinder power take-off gear coupled to each of said plurality of grinders for driving said grinders in rotation, and said grinder power take-off gears are all meshed with said primary grinder power gear, and said primary grinder power gear has a pitch diameter greater than the pitch diameters of said grinder power take-off gears.

6. A multidisc floor grinding apparatus according to claim 5 wherein said pitch diameter of said primary grinder power gear is at least about twice said pitch diameters of said grinder power take-off gears.

7. A multidisc floor grinding apparatus according to claim 6 wherein the ratio of said pitch diameter of said primary grinder power gear to said pitch diameters of each said power take-off gears is about four to one.

8. A multidisc floor grinding apparatus according to claim 1 further comprising a drive pulley coupled to said main drive shaft and an endless belt driving said drive pulley and driven by said power source thereby providing a flexible coupling between said power source and said main drive shaft.

9. A multidisc floor grinding machine comprising:

a chassis supported upon a plurality of wheels for movement across a floor, a bearing housing supported by said chassis upon a bearing housing support axis oriented parallel to said floor, a main drive shaft mounted on said bearing housing for rotation relative thereto about a main drive shaft axis, a grinder mounting frame located beneath and oriented parallel to said bearing housing support axis and oriented perpendicular to said main drive shaft axis for rotation relative thereto about a grinder mounting frame axis oriented perpendicular to and intersecting said bearing housing support axis, a grinder mounting frame drive mechanism that couples said main drive shaft to drive said grinder mounting frame in rotation at a reduced angular velocity relative to that of said main drive shaft, a plurality of grinders each having a grinding element and a grinder axis oriented parallel to said grinder mounting frame axis, wherein said grinders are all mounted for rotation on said grinder frame in spaced separation from each other and from said grinder mounting frame axis, a grinder drive mechanism coupling said main drive shaft to said plurality of grinders to drive said grinder elements at an increased angular velocity relative to that of said grinder mounting frame, and a power source coupled to drive said main drive shaft in rotation;

further characterized in that said grinder mounting frame is coaxially mounted on said main drive shaft and further comprising grinder frame bearings interposed between said main drive shaft and said grinder mounting frame, and said grinder mounting frame drive mechanism includes grinder mounting frame speed reducing components that effectuate a speed reduction from said main drive shaft to said grinder mounting frame of at least twenty-five to one.

10. A multidisc floor grinding machine according to claim 9 wherein said grinder mounting frame speed reducing components include: a power transfer shaft journaled in said grinder mounting frame for rotation about a transfer shaft axis that is parallel to and radially spaced from said main drive shaft axis, a pinion sprocket coupled to said power transfer shaft, a base sprocket coupled to said bearing housing and coaxial with said main drive shaft axis, an endless chain engaged with both said base sprocket and said pinion sprocket, transfer elements secured to said main drive shaft and to said transfer shaft and engaged with each other, whereby rotation of said main drive shaft advances said power transfer shaft in circular orbital movement about said main drive shaft axis, carrying said grinder mounting frame therewith.

11. A multidisc floor grinding machine according to claim 10 wherein said transfer elements include meshed gears on said main drive shaft and said power transfer shaft.

12. A multidisc floor grinding machine according to claim 11 wherein said transfer elements further include an intermediate shaft having gears thereon that are meshed with said meshed gears on said main drive shaft and said power transfer shaft.

13. A multidisc floor grinding machine according to claim 9 wherein said grinder drive mechanism is comprised of a set of grinder driving gears coupled between said main drive shaft and said plurality of grinders to drive said plurality of grinders at more than twice the angular velocity of said main drive shaft.

14. A multidisc floor grinding machine according to claim 13 wherein said set of grinder driving gears rotates each of said grinders at an angular velocity about four times that of said main drive shaft.

15. A multidisc floor grinding machine according to claim 9 further comprising gimbals that support said bearing housing on said chassis and a flexible coupling between said power source and said main drive shaft to accommodate movement of said bearing housing on said gimbals.

16. A multidisc floor grinding mechanism according to claim 15 wherein said flexible coupling between said power source and said main drive shaft is comprised of a belt drive.

17. A multidisc floor grinder comprising:

a chassis, wheels supporting said chassis to carry it across a floor surface, a bearing housing mounted by gimbals on said chassis for movement relative thereto about a bearing housing axis that is parallel to said floor, a main drive shaft supported by bearings in said bearing housing to depend from said bearing housing and rotatable relative thereto about a main drive shaft axis that is perpendicular to and intersects said bearing housing axis, a grinder mounting frame supported by said main drive shaft and extending radially therefrom for rotation about said main drive shaft axis relative to said main drive shaft, a grinder mounting frame drive mechanism coupled between said main drive shaft and said grinder mounting frame to drive said grinder mounting frame is rotation relative to said chassis at a speed reduced from that of said main drive shaft, a plurality of grinders mounted on said grinder mounting frame for rotation relative thereto about grinder axes that are parallel to and radially displaced from said main drive shaft axis, and wherein each of said grinders is equipped with a grinder element depending therefrom which has a radius smaller than the distance of displacement of said grinder axes from said main drive shaft axis, a grinder drive mechanism coupled between said main drive shaft and said grinders to rotate said grinder elements about their respective grinder axes at a speed greater than that of said main drive shaft, a power source mounted on said chassis, and a main drive mechanism coupled between said power source and said main drive shaft to rotate said main drive shaft about said main drive shaft axis while permitting movement of said bearing housing in said gimbals;

wherein said grinder mounting frame drive mechanism includes speed reduction components that reduce the speed of rotation of said grinder mounting frame to no less than about one-twenty-fifth that of said main drive shaft and said grinder drive mechanism includes speed increasing components that increase the speed of rotation of said grinders to at least twice that of said main drive shaft.

* * * * *